US008194025B2

(12) United States Patent
Son et al.

(10) Patent No.: US 8,194,025 B2
(45) Date of Patent: Jun. 5, 2012

(54) LIQUID CRYSTAL DISPLAY

(75) Inventors: Ji-Hyeon Son, Seongnam-si (KR); Kyung-Ho Park, Cheonan-si (KR); Seung-Hyun Hur, Cheonan-si (KR); Jang-Il Kim, Asan-si (KR); Jae-Yong Shin, Daegu (KR); Woo-Sung Sohn, Seoul (KR); Yun-Seok Lee, Cheonan-si (KR); In-Woo Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 400 days.

(21) Appl. No.: 12/511,740

(22) Filed: Jul. 29, 2009

(65) Prior Publication Data

US 2010/0033418 A1 Feb. 11, 2010

(30) Foreign Application Priority Data

Aug. 6, 2008 (KR) ..... 10-2008-0077032

(51) Int. Cl.
*G09G 3/36* (2006.01)

(52) U.S. Cl. ..... 345/98; 345/87; 345/100

(58) Field of Classification Search ..... 345/87–100; 349/46, 190

See application file for complete search history.

(56) References Cited

U.S. PATENT DOCUMENTS

| | | | | |
|---|---|---|---|---|
| 7,023,410 | B2 * | 4/2006 | Lee et al. | 345/87 |
| 7,643,003 | B2 * | 1/2010 | Chun et al. | 345/100 |
| 7,859,507 | B2 * | 12/2010 | Jang et al. | 345/100 |
| 7,880,714 | B2 * | 2/2011 | Jang et al. | 345/100 |
| 2007/0052658 | A1 * | 3/2007 | Kim | 345/100 |
| 2007/0146289 | A1 * | 6/2007 | Lee et al. | 345/100 |
| 2007/0164954 | A1 * | 7/2007 | Yang et al. | 345/88 |
| 2008/0266477 | A1 * | 10/2008 | Lee et al. | 349/46 |

FOREIGN PATENT DOCUMENTS

| | | |
|---|---|---|
| JP | 2004004512 | 1/2004 |
| KR | 1020050046173 | 5/2005 |
| KR | 1020060075586 | 7/2006 |
| KR | 1020060124835 | 12/2006 |
| KR | 1020070020675 | 2/2007 |
| KR | 1020080001403 | 1/2008 |

* cited by examiner

*Primary Examiner* — Kimnhung Nguyen

(74) *Attorney, Agent, or Firm* — H.C. Park & Associates, PLC

(57) ABSTRACT

The present invention provides a liquid crystal display (LCD). The LCD includes: a liquid crystal panel that includes a plurality of gate lines; and a gate driver that includes a plurality of stages, which are connected to the gate lines, respectively, and sequentially provide a plurality of gate signals to the gate lines, respectively, and a first dummy stage and a second dummy stage that are separated from each other, wherein the first dummy stage is enabled by a carry signal of one of the stages, and the second dummy stage is enabled by a carry signal of the first dummy stage and initializes each of the stages.

20 Claims, 10 Drawing Sheets

LIQUID CRYSTAL DISPLAY

This application claims priority from and the benefit of Korean Patent Application No. 10-2008-0077032, filed on Aug. 6, 2008, which is hereby incorporated by reference for all purposes as if fully set forth herein.

BACKGROUND OF THE INVENTION

1. Field of the Invention

The present invention relates to a liquid crystal display (LCD).

2. Discussion of the Background

In conventional liquid crystal displays (LCDs), gate-driving integrated circuits (ICs) may be mounted using a method such as a tape carrier package (TCP) or chip-on-glass (COG). However, research is being conducted to find other methods in terms of manufacturing costs, product size, and design. New methods are being attempted of mounting a gate driver, which generates gate signals using amorphous silicon thin-film transistors (a-Si TFTs), on a glass substrate, instead of gate-driving ICs. Attempts are being made to improve the display quality of LCDs having such a gate driver.

SUMMARY OF THE INVENTION

The present invention provides a liquid crystal display (LCD) with improved display quality.

Additional features of the invention will be set forth in the description which follows, and in part will be apparent from the description, or may be learned by practice of the invention.

The present invention discloses an LCD that includes: a liquid crystal panel that includes a plurality of gate lines; and a gate driver that includes a plurality of stages, which are connected to the gate lines, respectively, and sequentially provide a plurality of gate signals to the gate lines, respectively, and a first dummy stage and a second dummy stage, which are separated from each other, wherein the first dummy stage is enabled by a carry signal of any one of the stages, and the second dummy stage is enabled by a carry signal of the first dummy stage and initializes each of the stages.

The present invention also discloses an LCD that includes: a liquid crystal panel that includes a plurality of gate lines; and a gate driver that includes a plurality of stages, which are connected to the gate lines, respectively, and sequentially provide a plurality of gate signals to the gate lines, respectively, and a dummy stage, wherein each of the stages and the dummy stage includes: a charging unit that is charged with electric charges in response to a scan start signal or a carry signal of a previous stage; a pull-up unit that provides a gate signal in response to a first clock signal or a second clock signal when the charging unit is charged; a pull-down unit that pulls down the gate signal to a gate-off voltage in response to a gate signal of a next stage or an initialization signal; a discharging unit that discharges the electric charges from the charging unit; and a holding unit that holds the gate signal, wherein the dummy stage includes a pull-up transistor larger than that of each of the stages.

The present invention also discloses an LCD that includes: a liquid crystal panel that includes a plurality of gate lines; and a gate driver that includes a plurality of stages, which are connected to the gate lines, respectively, and sequentially provide a plurality of gate signals to the gate lines, respectively, and a dummy stage, wherein each of the stages and the dummy stage includes a gate output terminal which provides a gate signal, and the gate signal output from the gate output terminal of the dummy stage has a smaller output than the gate signal output from the gate output terminal of each of the stages.

The present invention also discloses a LCD that includes: an liquid crystal panel that includes a plurality of gate lines, and a gate driver comprising a plurality of stages, which are connected to the gate lines, respectively, and sequentially provide a plurality of gate signals to the gate lines, respectively, and a dummy stage, in which a portion of the plurality of stages and the dummy stage are initialized for each frame in response to an initialization signal, and the remaining stages among the plurality of stages and the dummy stage are initialized for each frame in response to a scan start signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
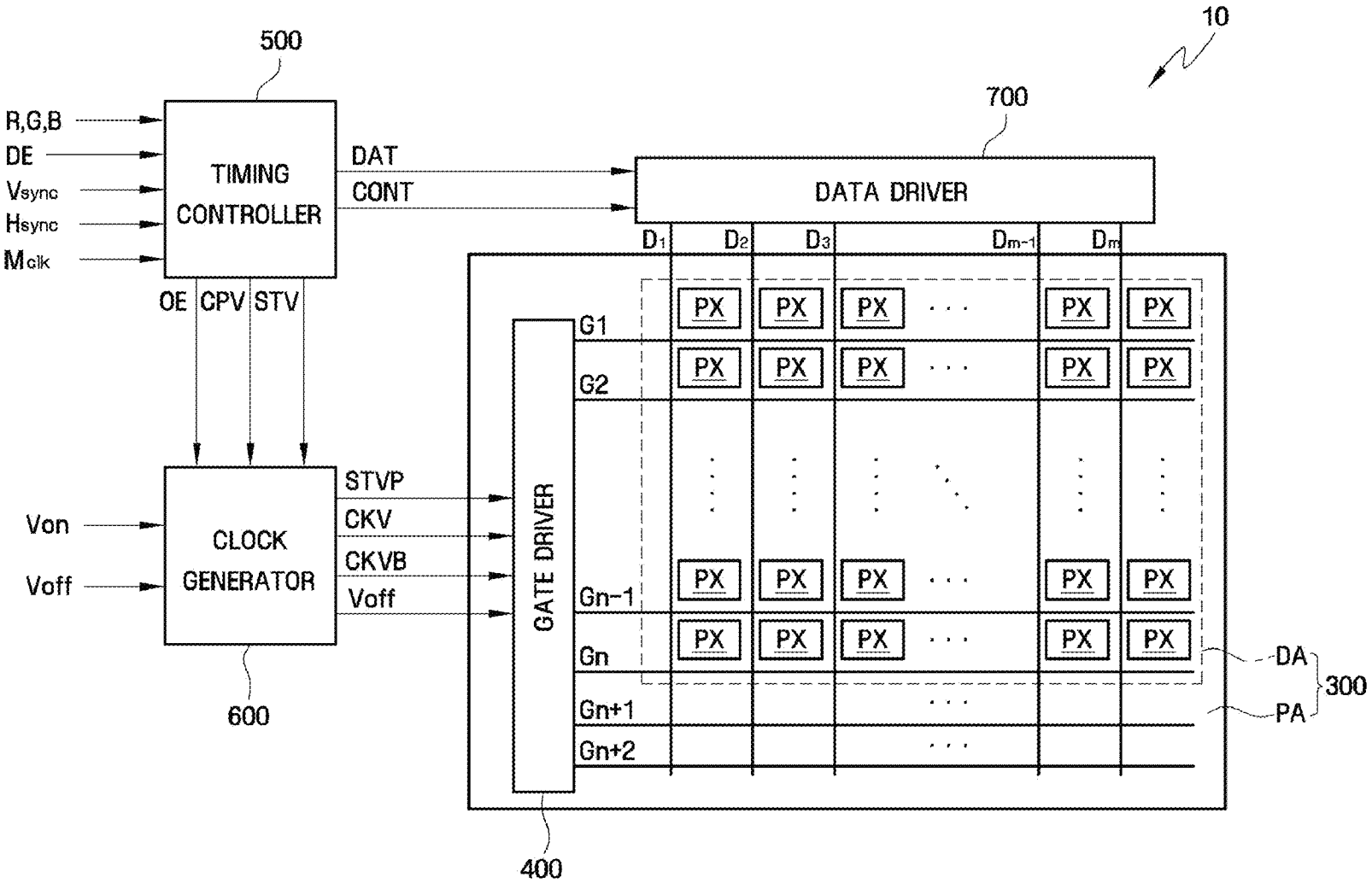
FIG. 1 is a block diagram showing a liquid crystal display (LCD) and a method of driving the same according to exemplary embodiments of the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element is referred to as being "connected to" or "coupled to" another element, it can be directly connected or coupled to the other element or intervening elements may be present. In contrast, when an element is referred to as being "directly connected to" or "directly coupled to" another element, there are no intervening elements present. Like numbers refer to like elements throughout. As used herein, the term "and/or" includes any and all combinations of one or more of the associated listed items.

It will be understood that, although the terms first, second, third, etc., may be used herein to describe various elements, components and/or sections, these elements, components and/or sections should not be limited by these terms. These terms are only used to distinguish one element, component or section from another element, component or section. Thus, a first element, component or section discussed below could be termed a second element, component or section without departing from the teachings of the present invention.

The terminology used herein is for the purpose of describing particular exemplary embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated components, steps, operations, and/or elements, but do not preclude the presence or addition of one or more other components, steps, operations, elements, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, a liquid crystal display (LCD) and a method of driving the same according to exemplary embodiments of the present invention will be described. An LCD and a method of driving the same according to an exemplary embodiment of the present invention will be described with reference to FIG. 1, FIG. 2, FIG. 3, FIG. 4, FIG. 5, and FIG. 6.

Referring to FIG. 1, the LCD 10 according to an exemplary embodiment of the present invention may include a liquid crystal panel 300, a timing controller 500, a clock generator 600, the gate driver 400, and a data driver 700. The timing controller 500 and the clock generator 600 may form a signal provider.

The liquid crystal panel 300 may be divided into a display region DA where images are displayed, and a non-display region (PA) where no image is displayed.

The display region DA, in which images are displayed, may include a first substrate 100 (see FIG. 2) on which a plurality of gate lines G1 through Gn, a plurality of data lines D1 through Dm, a plurality of switching devices (not shown), and a plurality of pixel electrodes (not shown) are formed, a second substrate 200 (see FIG. 2) on which a plurality of color filters (not shown) and a plurality of common electrodes (not shown) are formed, and a liquid crystal layer (not shown) which is disposed between the first and second substrates 100 and 200. The gate lines GI through Gn may extend in a row direction to be substantially parallel to each other, and the data lines DI through Dm may extend in a column direction to be substantially parallel to each other. The liquid crystal panel 300 may further include a plurality of dummy gate lines Gn+1 and Gn+2, in addition to the gate lines G1 through Gn. The dummy gate lines will be described in more detail below.

Figure 2:
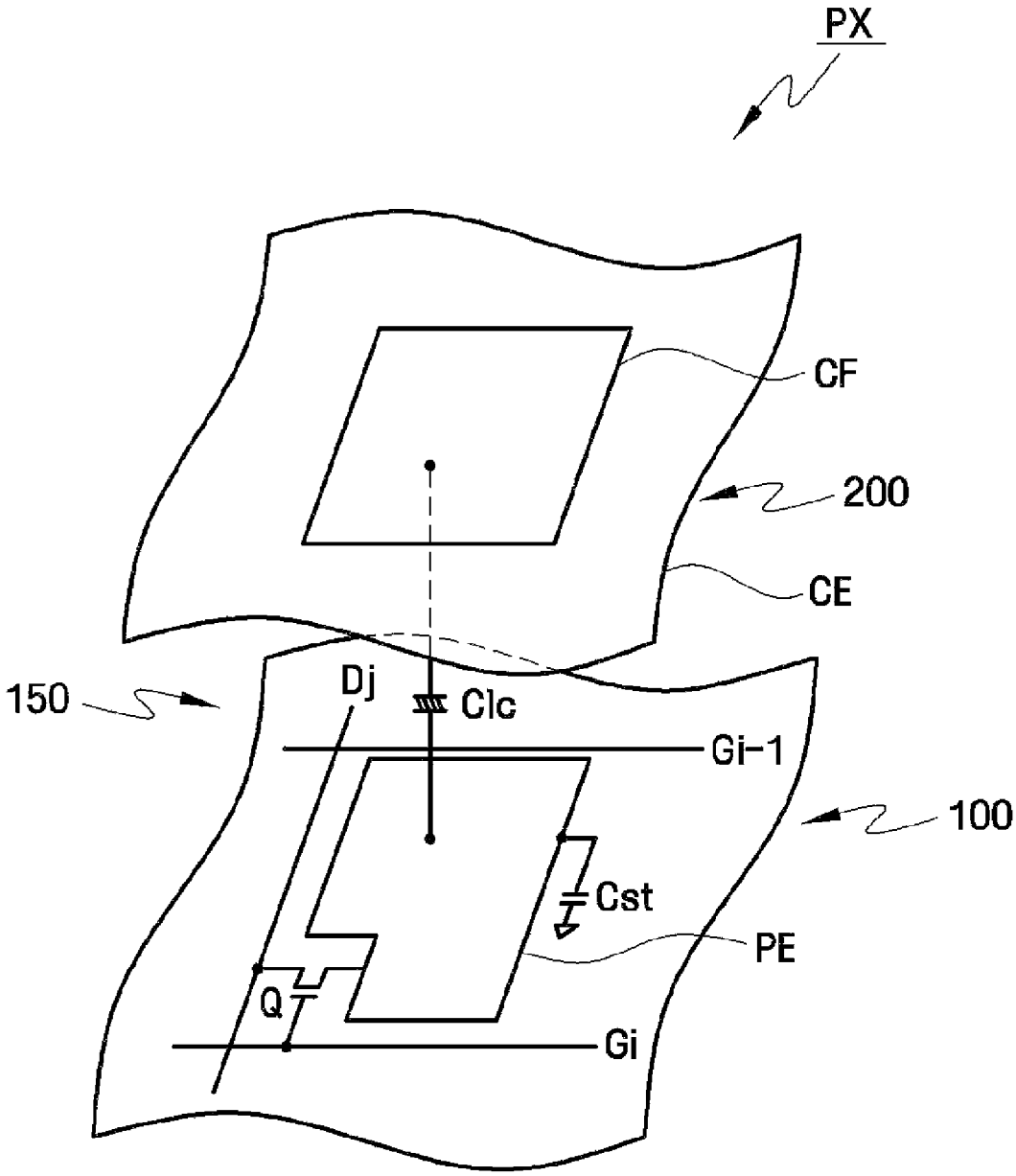
FIG. 2 is an equivalent circuit diagram of a pixel included in the LCD of FIG. 1.

Referring to FIG. 2, each of the pixels PX shown in FIG. 1 may include a pixel electrode PE, which is formed on the first substrate 100, and a color filter CF, which is formed on a portion of a common electrode CE on the second substrate 200 to face the pixel electrode PE. The pixel PX may be connected to, for example, an $i^{th}$ (i=1 to n) gate line Gi and a $j^{th}$(j=1 to m) data line Dj. The pixel PX may include a switching device Q, which is connected to the $i^{th}$ gate line Gi and the $j^{th}$ data line Dj, and a liquid crystal capacitor Clc and a storage capacitor Cst, which are connected to the switching device Q. The storage capacitor Cst may be omitted. The switching device Q may be a thin-film transistor made of amorphous silicon (a-Si).

Images are not displayed in the non-display region PA, which may be formed by having the first substrate 100 (see FIG. 2) wider than the second substrate 200 (see FIG. 2).

The signal provider may include the timing controller 500 and the clock generator 600. The signal provider may receive input image signals R, G, and B, and control signals for controlling the display of the input image signals R, G, and B from an external graphics controller (not shown). The signal provider may provide image signals DAT and data control signals CONT to the data driver 700. The timing controller 500 may receive control signals, such as a horizontal synchronization signal Hsync, a vertical synchronization signal Vsync, a main clock signal Mclk, R, G, B image data, and a data enable signal DE, and output the data control signals CONT. The data control signals CONT are used to control the operation of the data driver 700, and include a horizontal start signal for starting the data driver 700 and a load signal for instructing the output of two data voltages.

The data driver 700 receives the image signals DAT and the data control signals CONT, and provides image data voltages corresponding to the image signals DAT to the data lines D1 through Dm, respectively. As an integrated circuit (IC), the data driver 700 may be connected to the liquid crystal panel 300 in the form of a tape carrier package (TCP). However, the present invention is not limited thereto. The data driver 700 may be formed on the non-display region PA.

The signal provider may also receive a vertical synchronization signal Vsync and the main clock signal Mclk from the external graphics controller (not shown), and receive a gate-on voltage Von and a gate-off voltage Voff from a voltage generator (not shown). Then, the signal provider may provide a first scan start signal STVP, a clock signal CKV, a clock bar signal CKVB, and the gate-off voltage Voff to the gate driver 400. The timing controller 500 may provide a second scan start signal STV, a first clock generation control signal OE, and a second clock generation control signal CPV to the clock generator 600. Then, the clock generator 600 may receive the second scan start signal STV and output the first scan start signal STVP. The clock generator 600 may also receive the first clock generation control signal OE and the second clock generation control signal CPV, and output the clock signal CKV and the clock bar signal CKVB, respectively. The clock signal CKV may be a revere phase signal of the clock bar signal CKVB.

The gate driver 400 is enabled by the first scan start signal STVP, generates a plurality of gate signals by using the clock signal CKV, the clock bar signal CKVB, and the gate-off voltage Voff, and sequentially transmits the gate signals to the gate lines G1 through Gn, respectively. Although not shown in the drawing, the liquid crystal panel 300 may further include a plurality of dummy gate lines, and at least some of the dummy gate lines may be connected to the first dummy stage $ST_{n+1}$. The gate driver 400 will be described in more detail below with reference to FIG. 3.

Figure 3:
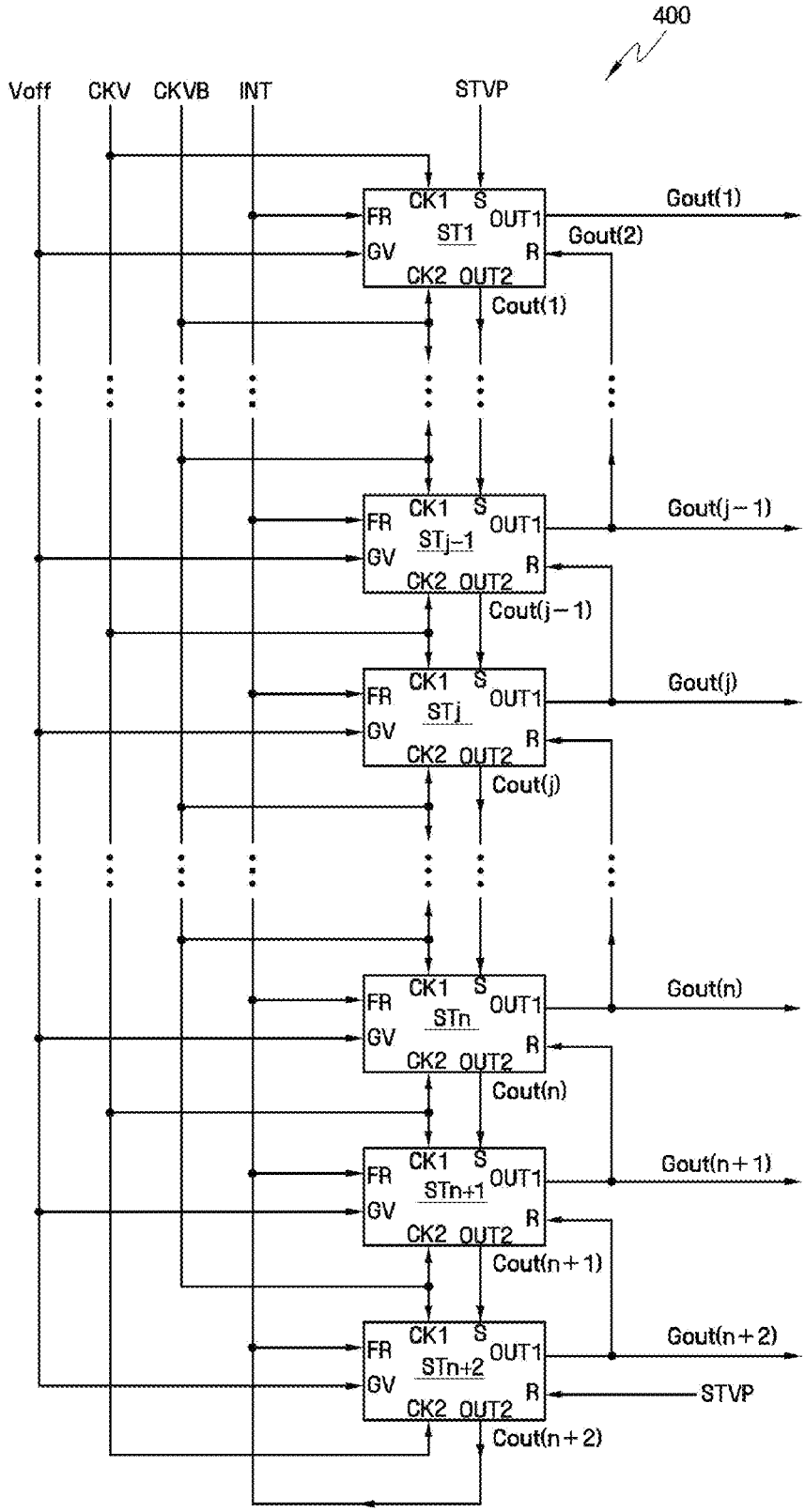
FIG. 3 is a block diagram of a gate driver shown in FIG. 1.

Referring to FIG. 3, the gate driver 400 includes first through $n^{th}$ stages $ST_1$ through $ST_n$, which are connected to the gate lines G1 through Gn, respectively, and transmit a plurality of gate signals $Gout_{(1)}$ through $Gout_{(n)}$ to the gate lines G1 through Gn, respectively. The gate driver 400 also includes the first and second dummy stages $ST_{n+1}$ and $ST_{n+2}$, which are separated from each other. The first dummy stage $ST_{n+1}$ is enabled by a carry signal output from any one of the first through $n^{th}$ stages $ST_1$ through $ST_n$, and the second dummy stage $ST_{n+2}$ is enabled by a carry signal $Cout_{(n+1)}$ output from the first dummy stage $ST_{n+1}$, and initializes each of the first through $n^{th}$ stages $ST_1$ through $ST_n$.

The first through $n^{th}$ stages $ST_1$ through $ST_n$ and the first and second dummy stages $ST_{n+1}$ and $ST_{n+2}$ may be connected to each other in a cascade manner. The gate-off voltage Voff, the clock signal CKV, the clock bar signal CKVB, and an initialization signal INT may be input to each of the first through $n^{th}$ stages $ST_1$ through $ST_n$ and the first and second dummy stages $ST_{n+1}$ and $ST_{n+2}$. Here, the initialization signal INT may be provided by the second dummy stage $ST_{n+2}$.

Each of the first through n h stages $ST_1$ through $ST_n$ and the first and second dummy stages $ST_{n+1}$ and $ST_{n+2}$ may include a first clock terminal CK1, a second clock terminal CK2, a set terminal S, a reset terminal R, a voltage source terminal GV, a frame reset terminal FR, a gate output terminal OUT1, and a carry output terminal OUT2.

The $j^{th}$ stage $ST_j$ connected to the $j^{th}$ ($j \neq 1$) gate line Gj will now be described as an example. A carry signal $Cout_{(j-1)}$ of a previous stage, i.e., the $(j-1)^{th}$ stage $ST_{j-1}$, may be input to the set terminal S of the $j^{th}$ stage $ST_j$, a gate signal $Gout_{(j+1)}$ of a next stage, i.e., the $(j+1)^{th}$ stage $ST_{j+1}$, may be input to the reset terminal R thereof, and the clock signal CKV and the clock bar signal CKVB may be input to the first clock terminal CK1 and the second clock terminal CK2, respectively. The gate-off voltage Voff may be input to the voltage source terminal GV of the $j^{th}$ stage $ST_j$, and the initialization signal INT or a carry signal $Cout_{(n+2)}$ of the second dummy stage $ST_{n+2}$ may be input to the frame reset terminal FR thereof. The gate output terminal OUT1 may output a gate signal $Gout_{(j)}$, and the carry output terminal OUT2 may output a carry signal $Cout_{(j)}$.

However, the first scan start signal STVP may be input to the first stage $ST_1$ instead of a carry signal of its previous stage, and the first scan start signal STVP may be input to the second dummy stage $ST_{n+2}$ instead of a gate signal of its next stage.

Figure 4:
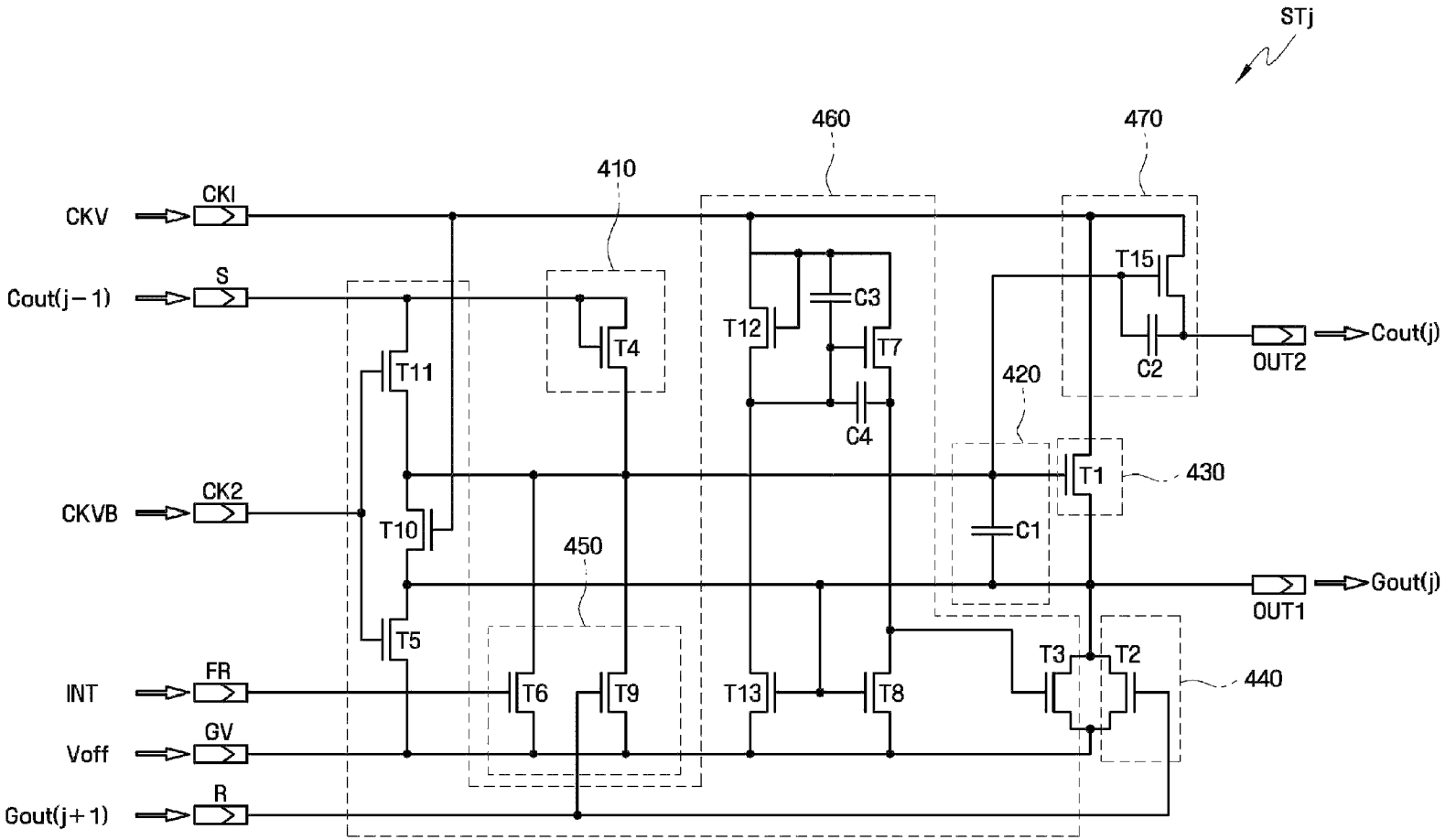
FIG. 4 is a circuit diagram of a $j^{th}$ stage shown in FIG. 3.

The $j^{th}$ stage $ST_j$ shown in FIG. 3 will now be described in more detail with reference to FIG. 4. Referring to FIG. 4, the $j^{th}$ stage $ST_j$ may include a buffer unit 410, a charging unit 420, a pull-up unit 430, a carry signal generation unit 470, a pull-down unit 440, a discharging unit 450, and a holding unit 460. The carry signal $Cout_{(j-1)}$ of the previous stage, i.e., the $(j-1)^{th}$ stage $ST_{j-1}$, the clock signal CKV, and the clock bar signal CKVB are provided to the $j^{th}$ stage $ST_j$.

The buffer unit 410 may include a diode-connected transistor T4. The buffer unit 410 may provide the carry signal $Cout_{(j-1)}$ of the previous stage, i.e., the $(j-1)^{th}$ stage $ST_{j-1}$, received through the set terminal S of the $j^{th}$ stage $ST_j$ to the charging unit 420, the carry signal generation unit 470, the discharging unit 450, and the holding unit 460, which are connected to a source of the buffer unit 410.

The charging unit 420 may include a capacitor C1 having a first terminal, which is connected to the source of the transistor T4 and the discharging unit 450, and a second terminal which is connected to the gate output terminal OUT1. The charging unit 420 may be charged with electric charges in response to the carry signal $Cout_{(j-1)}$ of the previous stage, i.e., the $(j-1)^{th}$ stage $ST_{j-1}$, received through the set terminal S.

The pull-up unit 430 may include a transistor T1 having a drain which is connected to the first clock terminal CK1, a gate which is connected to the first terminal of the capacitor C1, and a source which is connected to the second terminal of the capacitor C1 and the gate output terminal OUT1. When the capacitor C1 of the charging unit 420 is charged, the transistor T1 may be turned on. Accordingly, the transistor T1 may provide the first clock signal CKV, which is received through the first clock terminal CK1, as the gate signal $Gout_{(j)}$ through the gate output terminal OUT1. That is, when the first clock signal CKV is at a high level, the gate-on voltage Von may be output.

The carry signal generation unit 470 may include a transistor T15 and a capacitor C2. The transistor T15 has a drain which is connected to the first clock terminal CK1, a gate which is connected to the buffer unit 410, and a source which is connected to the carry output terminal OUT2. The capacitor C2 is connected to the gate and the source of the transistor T15. The capacitor C2 is charged in the same way as the charging unit 420. When the capacitor C2 is charged, the transistor T15 outputs the first clock signal CKV as the carry signal $Cout_{(j)}$ through the carry output terminal OUT2.

The pull-down unit 440 may include a transistor T2 having a drain which is connected to the source of the transistor T1 and the second terminal of the capacitor C1, a gate which is connected to the reset terminal R, and a source which is connected to the voltage source terminal GV. The pull-down unit 440 is turned on by a gate signal $Gout_{(j+1)}$ of a next stage, i.e., the $(j+1)^{th}$ stage $ST_{(j+1)}$, which is received through the reset terminal R, and pulls down the gate signal $Gout_{(j)}$ to the gate-off voltage Voff.

The discharging unit 450 may include a transistor T9 and a transistor T6. The transistor T9 has a drain which is connected to the first terminal of the capacitor C1, a gate which is connected to the reset terminal R, and a source which is connected to the voltage source terminal GV. The transistor T9 discharges the charging unit 420 in response to the gate signal $Gout_{(j+1)}$ of the next stage, i.e., the $(j+1)^{th}$ stage $ST_{(j'1)}$. The transistor T6 has a drain which is connected to the first terminal of the capacitor C1, a gate which is connected to the frame reset terminal FR, and a source which is connected to the voltage source terminal GV. The transistor T6 discharges the charging unit 420 in response to the initialization signal INT. That is, the discharging unit 450 discharges electric charges from the capacitor C1 through a source thereof to the gate-off voltage Voff, in response to the gate signal $Gout_{(j+1)}$ of the next stage, i.e., the $(j+1)^{th}$ stage $ST_{(j+1)}$ or the initialization signal INT. Here, the initialization signal INT may be the carry signal $Cout_{(j+2)}$ of the second dummy stage $ST_{n+2}$.

The holding unit 460 may include a plurality of transistors T3, T5, T7, T8, T10, T11, T12, and T13. When the gate signal $Gout_{(j)}$ shifts from a low level to a high level, the holding unit 460 holds the gate signal $Gout_{(j)}$ at the high level. When the gate signal $Gout_{(j)}$ shifts from a high level to a low level, the holding unit 460 holds the gate signal Gouts) at the low level during a frame, irrespective of voltage levels of the clock signal CKV and the clock bar signal CKVB.

The transistor T3 has a drain which is connected to the gate output terminal OUT1 and a source which is connected to the gate-off voltage Voff. The transistors T7 and T8 are turned on when the gate signal $Gout_{(j)}$ output from the gate output terminal OUT1 is at a high level. Then, the transistors T7 and T8 pull down a gate of the transistor T3 to the gate-off voltage Voff and thus turn off the transistor T3. Therefore, the gate signal $Gout_{(j)}$ is held at the high level.

The transistor T11 has a drain which is connected to the set terminal S, a gate which is connected to a second clock terminal (CK2), and a source which is connected to the first terminal of the capacitor C1. The transistor T10 has a drain which is connected to the source of the transistor T11 and the first terminal of the capacitor C1, a gate which is connected to the first clock terminal CK1, and a source which is connected to the gate output terminal OUT1. The transistor T5 has a drain which is connected to the gate output terminal OUT1, a gate which is connected to the second clock terminal (CK2), and a source which is connected to the voltage source terminal GV. The gate of the transistor T11 and that of the transistor T5 share the second signal line.

When the second clock signal CKVB is at a high level, the gate signal $Gout_{(j)}$ is at a low level. Accordingly, the transistor T5 is turned on and holds the gate output terminal OUT1 at the gate-off voltage Voff.

Figure 5:
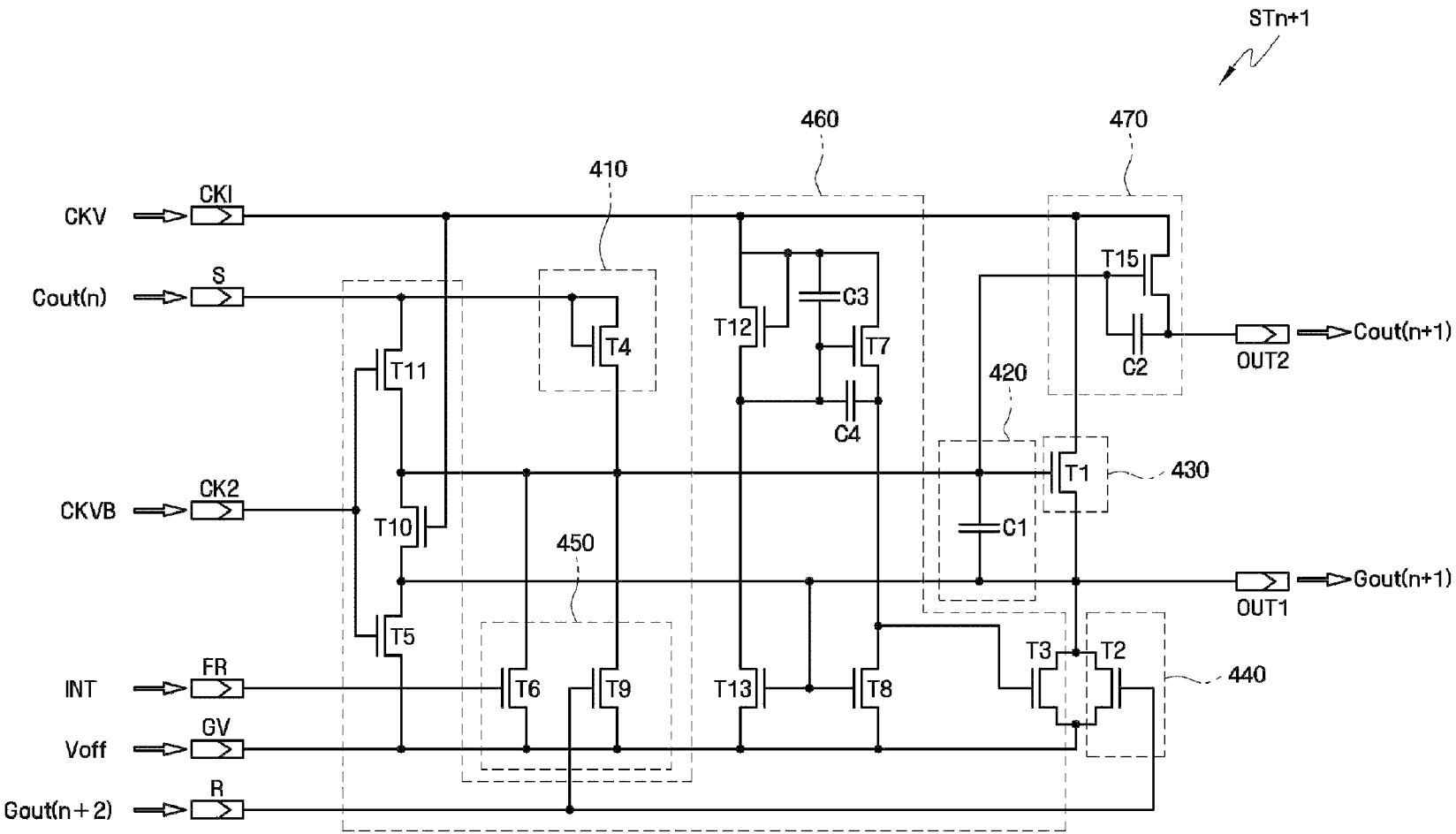
FIG. 5 is a circuit diagram of a first dummy stage shown in FIG. 3.
Figure 6:
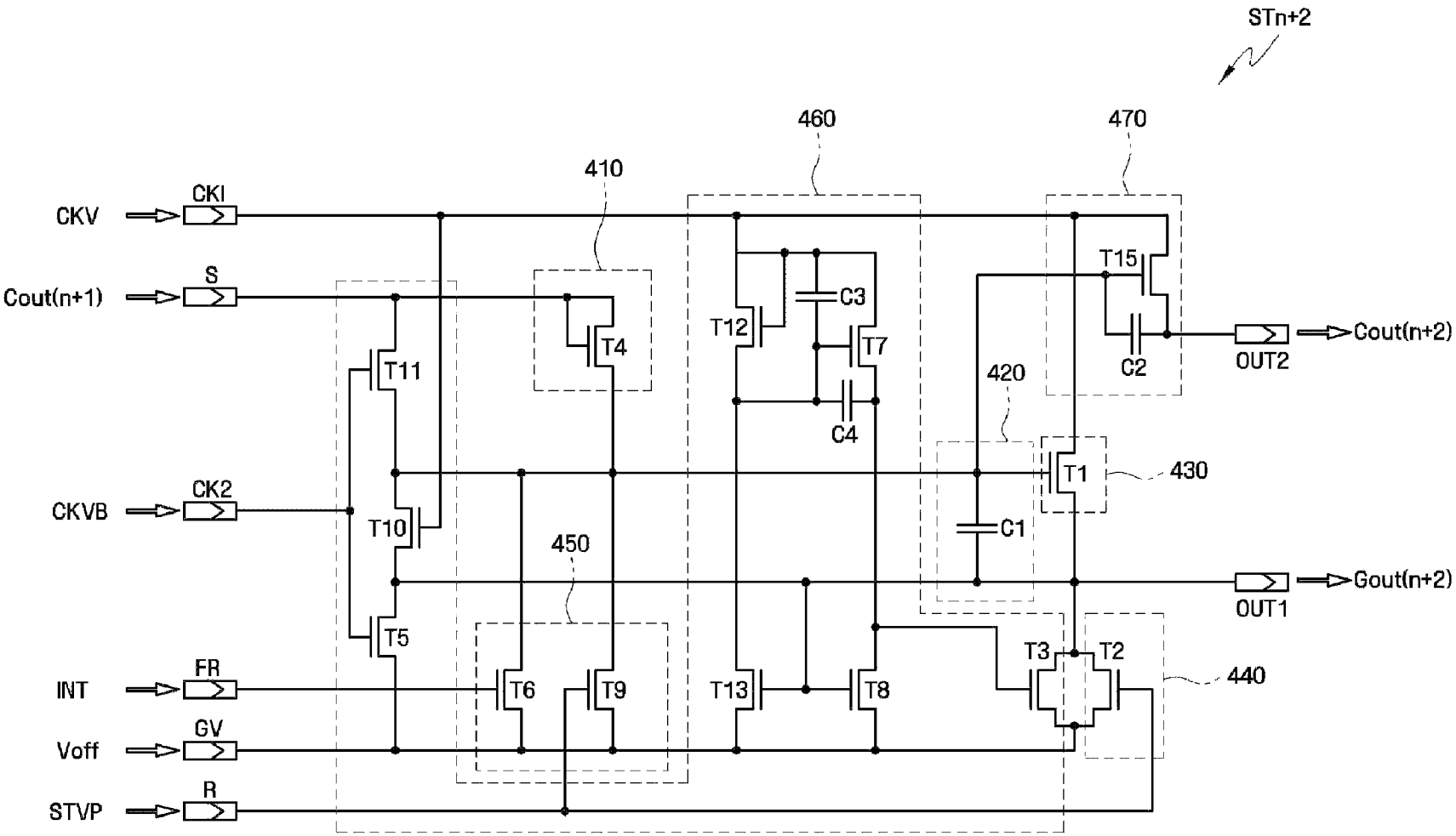
FIG. 6 is a circuit diagram of a second dummy stage shown in FIG. 3.

Hereinafter, the first and second dummy stages $ST_{n+1}$ and $ST_{n+2}$ will be described with reference to FIG. 3, FIG. 5, and FIG. 6. Elements having the same functions as those shown in FIG. 4 are indicated by like reference numerals, and thus their description will be omitted.

The first dummy stage $ST_{n+1}$ is enabled by a carry signal of any one of the first through $n^{th}$ stages $ST_1$ through $ST_n$. Here, the first dummy stage $ST_{n+1}$ may be enabled by a carry signal output from the last stage of the first through $n^{th}$ stages $ST_1$ through $ST_n$. The first dummy stage $ST_{n+1}$ may receive a carry signal $Cout_{(n)}$ output the $n^{th}$ stage $ST_1$ of the first through $n^{th}$ stages $ST_1$ through $ST_n$ which are arranged sequentially.

After being enabled by carry signal $Cout_{(n)}$ of the last stage, i.e., the $n^{th}$ stage $ST_n$, the first dummy stage $ST_{n+1}$ may operate in the substantially same way as the first through $n^{th}$ stages $ST_1$ through $ST_n$ described above. The first dummy stage $ST_{n+1}$ may be connected to at least some of the dummy gate lines which are formed in the liquid crystal panel 300 (see FIG. 1). However, even though the first dummy stage $ST_{n+1}$ transmits a gate signal $Gout_{(n+1)}$ to the liquid crystal panel 300 via the dummy gate lines, an image corresponding to the gate signal $Gout_{(n+1)}$ may not be displayed on the liquid crystal panel 300.

For example, the first dummy stage $ST_{n+1}$ may receive the carry signal $Cout_{(n)}$ of the $n^{th}$ stage $ST_n$ and output a carry signal $Cout_{(n+1)}$ and a gate signal $Gout_{(n+1)}$ in the same manner as the first through $n^{th}$ stages $ST_1$ through $ST_n$. The carry signal $Cout_{(n+1)}$ of the first dummy stage $ST_{n+1}$ is provided to the second dummy stage $ST_{n+2}$ and thus enables the second dummy stage $ST_{n+2}$. However, an image corresponding to the gate signal $Gout_{(n+1)}$ input to the liquid crystal panel 300 through the dummy gate lines may not be displayed on the liquid crystal panel 300.

The second dummy stage $ST_{n+2}$ may be enabled by the carry signal $Cout_{(n+1)}$ of the first dummy stage $ST_{n+1}$ and thus initialize each of the first through $n^{th}$ stages $ST_1$ through $ST_n$. The second dummy stage $ST_{n+2}$ may be enabled by the carry signal $Cout_{(n+1)}$ of the first dummy stage $ST_{n+1}$ and output a carry signal $Cout_{(n+2)}$ and a gate signal $Gout_{(n+2)}$.

The carry signal $Cout_{(n+2)}$ of the second dummy stage $ST_{n+2}$ is the initialization signal INT which initializes the first through $n^{th}$ stages $ST_1$ through $ST_n$. That is, the carry signal $Cout_{(n+2)}$ is provided to and thus initializes each of the first through $n^{th}$ stages $ST_1$ through $ST_n$. The second dummy stage $ST_{n+2}$ may provide the initialization signal INT to each of the first through $n^{th}$ stages $ST_1$ through $ST_n$ at every frame and thus initialize each of the first through $n^{th}$ stages $ST_1$ through $ST_n$. The initialization signal INT may also be provided to the first and second dummy stages $ST_{n+1}$ and $ST_{n+2}$.

The first and second dummy stages $ST_{n+1}$ and $ST_{n+2}$ are separated from each other. That is, the first dummy stage $ST_{n+1}$, which is separated from the second dummy stage $ST_{n+2}$, provides the gate signal $Gout_{(n+1)}$ to a previous stage, e.g., the $n^{th}$ stage $ST_n$ of the first through $n^{th}$ stages $ST_1$ through $ST_n$, which are sequentially arranged, to pull down the gate signal $Gout_{(n)}$ of the $n^{th}$ stage $ST_n$ to the gate-off voltage Voff. The first dummy stage $ST_{+1}$ may provide the carry signal $Cout_{(n+1)}$ to the second dummy stage $ST_{n+2}$ and thus enable the second dummy stage $ST_{n+2}$. The second dummy stage $ST_{n+2}$ is enabled by the carry signal $Cout_{(n+1)}$ of the first dummy stage $ST_{n+1}$ and provides the initialization signal INT to each of the first through $n^{th}$ stages $ST_1$ through $ST_n$ to discharge each of the first through $n^{th}$ stages $ST_1$ through $ST_n$.

The first and second dummy stages $ST_{n+1}$ and $ST_{n+2}$ may be physically separated from each other by forming independent circuits, respectively. Alternatively, the first and second dummy stages $ST_{n+1}$ and $ST_{n+2}$ may be functionally separated from each other. That is, the first dummy stage $ST_{n+1}$ initializes its previous stage, e.g., the $n^{th}$ stage $ST_n$, and enables the second dummy stage $ST_{n+2}$ while the second dummy stage $ST_{n+2}$ provides the initialization signal INT to each of the first through $n^{th}$ stages $ST_1$ through $ST_n$ and thus initializes each of the first through $n^{th}$ stages $ST_1$ through $ST_n$.

In the LCD 10 according to the present embodiment, the second dummy stage $ST_{n+2}$ provides the initialization signal INT to each of the first through $n^{th}$ stages $ST_1$ through $ST_n$. Thus, the first dummy stage $ST_{n+1}$ can sufficiently pull down the gate signal $Gout_{(n)}$ of its previous stage, e.g., the $n^{th}$ stage $ST_n$. As a result, the display quality of the LCD 10 can be enhanced.

Figure 7:
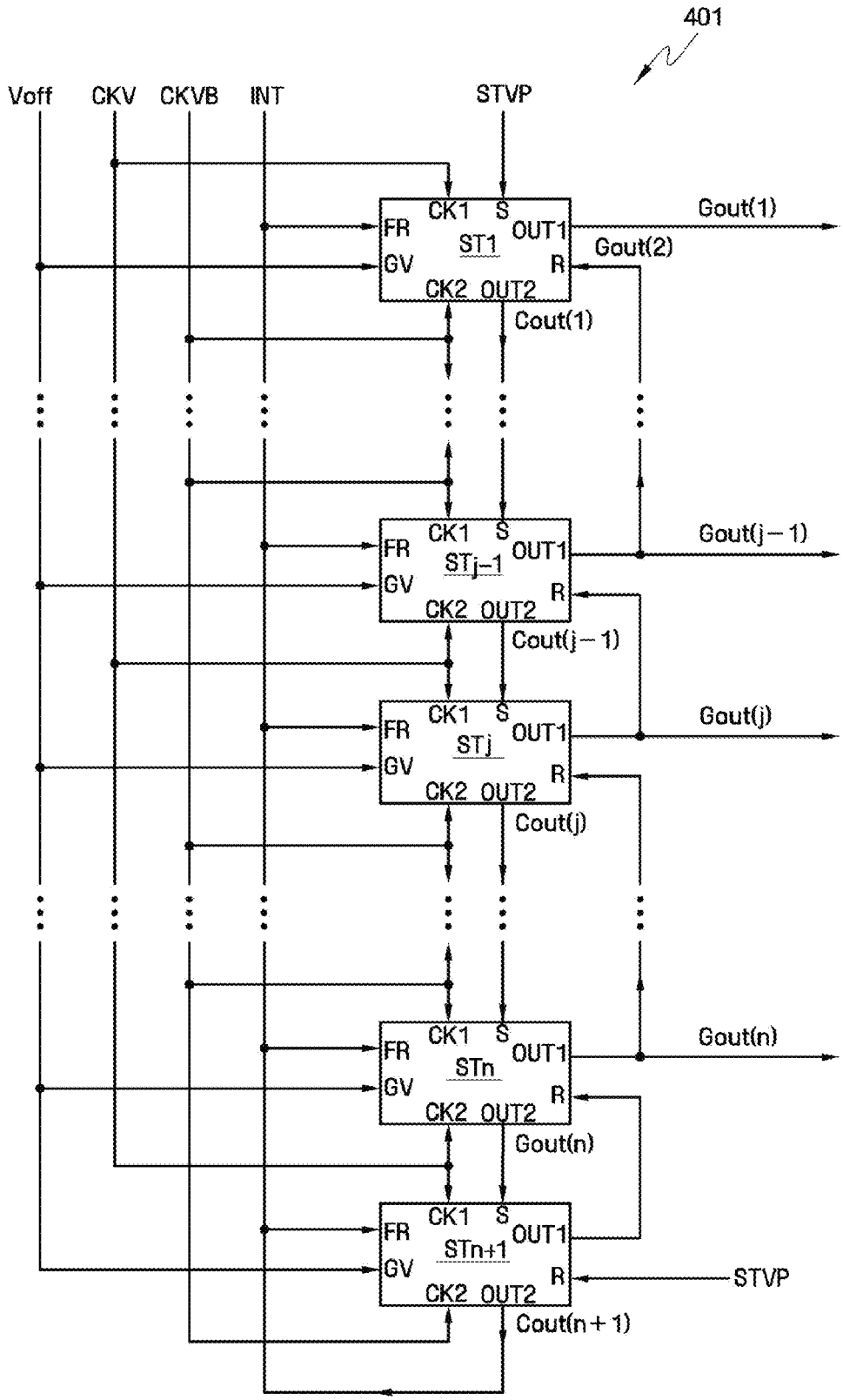
FIG. 7 is a block diagram of a gate driver included in an LCD according to another exemplary embodiment of the present invention.
Figure 8:
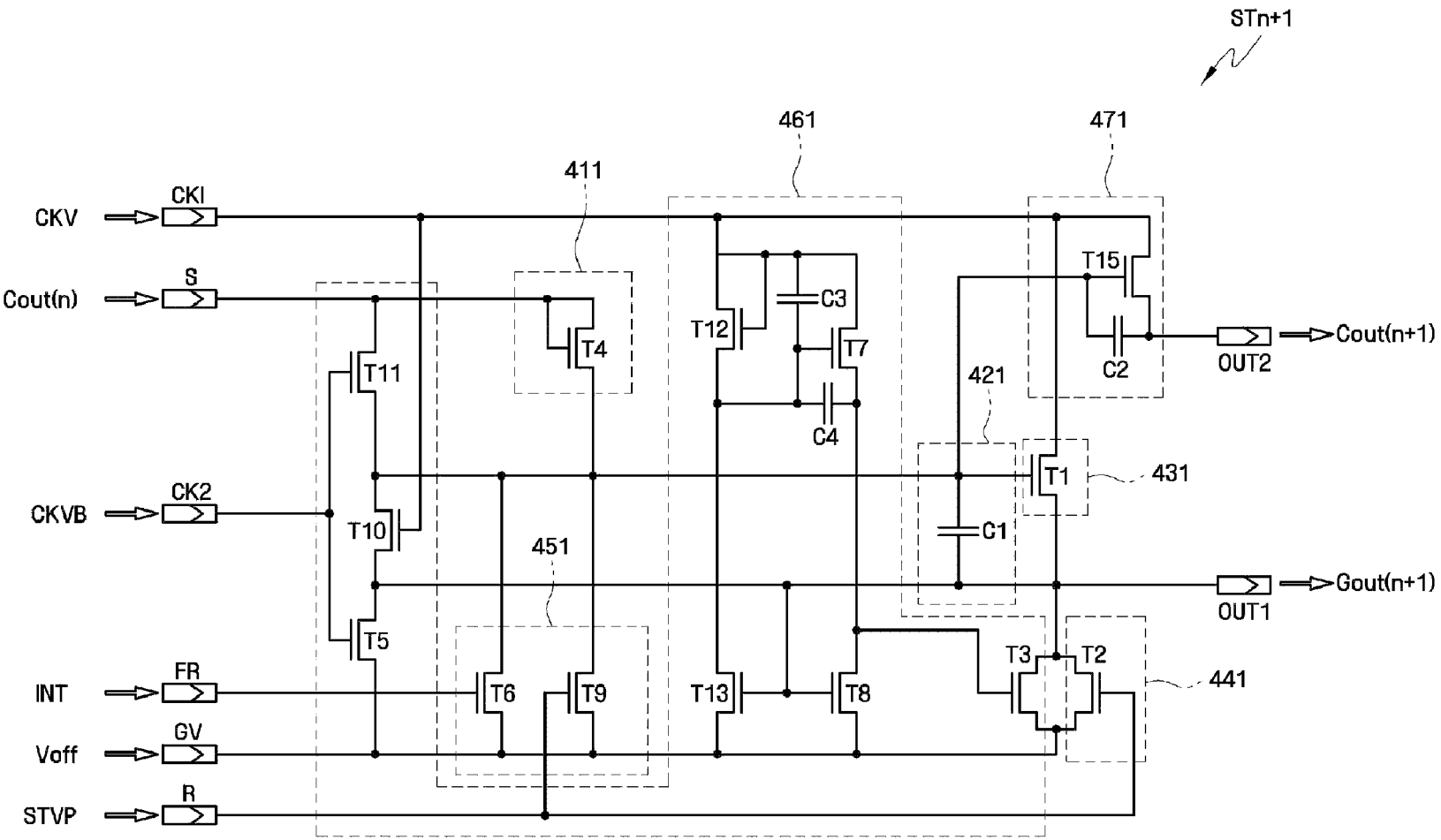
FIG. 8 is a circuit diagram of a dummy stage shown in FIG. 7.

Hereinafter, an LCD according to another exemplary embodiment of the present invention will be described with reference to FIG. 7 and FIG. 8. FIG. 7 is a block diagram of a gate driver 401 included in an LCD according to another exemplary embodiment of the present invention. FIG. 8 is a circuit diagram of a dummy stage $S_{n+1}$ shown in FIG. 7. Elements having the same functions as those shown in FIG. 1, FIG. 2, FIG. 3, FIG. 4, FIG. 5, and FIG. 6 are indicated by like reference numerals, and thus their description will be omitted.

Referring to FIG. 7 and FIG. 8, the gate driver 401 included in the LCD according to the present exemplary embodiment includes a plurality of gate lines G1 through Gn, first through nth stages $ST_1$ through $ST_n$, which are connected to the gate lines G1 through Gn, respectively, and sequentially provide gate signals $Gout_{(1)}$ through $Gout_{(n)}$, respectively, and the dummy stage $ST_{n+1}$.

Each of the first through $n^{th}$ stages $ST_1$ through $ST_n$ and the dummy stage $ST_{n+1}$ includes a buffer unit 411, charging unit 421, a pull-up unit 431, a pull-down unit 441, a discharging unit 451, a holding unit 461, and a carry signal generation unit 471. The charging unit 421 may be charged with electric charges in response to a scan start signal STVP or a carry signal of a previous stage. The pull-up unit 431 includes a pull-up transistor T1 which provides one of the gate signals $Gout_{(1)}$ through $Gout_{(n+1)}$ in response to a first clock signal CKV or a second clock signal CKVB when the charging unit 421 is charged. The pull-down unit 441 pulls down one of the gate signals $Gout_{(1)}$ through $Gout_{(n+1)}$ to a gate-off signal Voff in response to a gate signal of a next stage or an initialization signal INT. The discharging unit 451 discharges electric charges from the charging unit 421. The holding unit 461 holds one of the gate signals $Gout_{(1)}$ through $Gout_{(n+1)}$.

The pull-up transistor T1 of the dummy stage $ST_{n+1}$ is larger than that of each of the first through $n^{th}$ stages $ST_1$ through $ST_n$. Here, the pull-up transistor T1 of the dummy stage $ST_{n+1}$ may be approximately 20% larger than that of each of the first through nth stages $ST_1$ through $ST_n$. However, the present invention is not limited thereto. Here, the pull-up transistor T1 of the dummy stage $ST_{n-1}$ may be larger than that of each of the first through $n^{th}$ stages $ST_1$ through $ST_n$ in terms of an aspect ratio. That is, an aspect ratio of the pull-up transistor T1 of the dummy stage $ST_{n+1}$ may be higher than that of the pull-up transistor T1 of each of the first through $n^{th}$ stages $ST_1$ through $ST_n$.

When the charging unit 421 is charged, the pull-up transistor T1 of each of the first through $n^{th}$ stages $ST_1$ through $ST_n$ and the dummy stage $ST_{n+1}$ outputs one of the gate signals $Gout_{(1)}$ through $Gout_{(n+1)}$ through a gate output terminal OUT1 in response to the first clock signal CKV or the second clock signal CKVB. When a capacitor C2 is charged in the same way as the charging unit 421, the pull-up transistor T1 of each of the first through $n^{th}$ stages $ST_1$ through $ST_n$ and the dummy stage $ST_{n+1}$ outputs one of carry signals $Cout_{(1)}$ through $Cout_{(n+1)}$ through a carry output terminal OUT2.

The respective pull-up transistors T1 of the first through $n^{th}$ stages $ST_1$ through $ST_n$ may output the gate signals $Gout_{(1)}$ through $Gout_{(n)}$ to their respective previous stages and the gate lines G1 through Gn, which correspond to the first through $n^{th}$ stages $ST_1$, respectively, and may output the carry signals $Cout_{(1)}$ through $Cout_{(n)}$ to their respective next stages, respectively. The dummy stage $ST_{n+1}$ provides the carry signal $Cout_{(n+1)}$, i.e., the initialization signal INT, to each of the first through $n^{th}$ stages $ST_1$ through $ST_n$ and thus initializes each of the first through n stages $ST_1$ through $ST_n$.

An output signal of the pull-up transistor T1 of the dummy stage $ST_{n+1}$ may have a greater output voltage than that of each of the first through $n^{th}$ stages $ST_1$ through $ST_n$, which can be provided normally because the pull-up transistor T1 of the dummy stage $ST_{n+1}$ is larger than that of each of the first through $n^{th}$ stages $ST_1$ through $ST_n$. As a result, the display quality of the LCD may be improved.

Hereinafter, an LCD according to another exemplary embodiment of the present invention will be described. The LCD according to the present exemplary embodiment is different from those of the previous exemplary embodiments in that a dummy stage $ST_{n+1}$ has a smaller output than each of first through $n^{th}$ stages $ST_1$ through $ST_n$.

Referring to FIG. 7 and FIG. 8, the LCD according to the present exemplary embodiment includes a liquid crystal panel, which includes a plurality of gate lines G1 through Gn, and a gate driver. The gate driver includes the first through $n^{th}$ stages $ST_1$ through $ST_n$, which are connected to the gate lines G1 through Gn, respectively, and sequentially provide a plurality of gate signals $Gout_{(1)}$ through $Gout_{(n)}$ to the gate lines G1 through Gn, respectively, and a dummy stage $ST_{n+1}$. Each of the first through $n^{th}$ stages $ST_1$ through $ST_n$ and the dummy stage $ST_{n+1}$ includes a gate output terminal OUT1 to provide one of the gate signals $Gout_{(1)}$ through $Gout_{(n+1)}$.

The gate signal $Gout_{(n+1)}$ output from the gate output terminal OUT1 of the dummy stage $ST_{n+1}$ may have a smaller output voltage than one of the gate signals $Gout_{(1)}$ through $Gout_{(n)}$ which is output from the gate output terminal OUT1 of each of the first through $n^{th}$ stages $ST_1$ through $ST_n$. Here, the output voltage of the gate signal $Gout_{(n+1)}$ of the dummy stage $ST_{n+1}$ may be less than 80% of that of each of the respective gate signals $Gout_{(1)}$ through $Gout_{(n)}$ of the first through nth stages $ST_1$ through $ST_n$. Each of the gate signals $Gout_{(1)}$ through $Gout_{(n+1)}$ output from the first through $n^{th}$ stages $ST_1$ through $ST_n$ and the dummy stage $ST_{n+1}$, respectively, may have a predetermined voltage level. In this case, the voltage level of the gate signal $Gout_{(n+1)}$ of the dummy stage $ST_{n+1}$ is lower than that of each of the gate signals $Gout_{(1)}$ through $Gout_{(n)}$ output from the first through $n^{th}$ stages $ST_1$ through $ST_n$, respectively.

In order to reduce the output of the gate signal $Gout_{(n+1)}$ of the dummy stage $ST_{n+1}$, a pixel corresponding to a dummy gate line, which is connected to the dummy stage $ST_{n+1}$, may be removed. The output of the gate signal $Gout_{(n+1)}$ of the dummy stage $ST_{n+1}$ can also be reduced by using various other methods.

In the LCD according to the present exemplary embodiment, the signal $Gout_{(n+1)}$ output from the gate output terminal OUT1 of the dummy stage $ST_{n+1}$ may have a smaller output voltage than one of the gate signals $Gout_{(1)}$ through $Gout_{(n)}$ output from the gate output terminal OUT1 of each of the first through $n^{th}$ stages $ST_1$ through $ST_n$. Thus, the dummy stage $ST_{n+1}$ can sufficiently pull down its previous stage, which may improve the display quality of the LCD.

Figure 9:
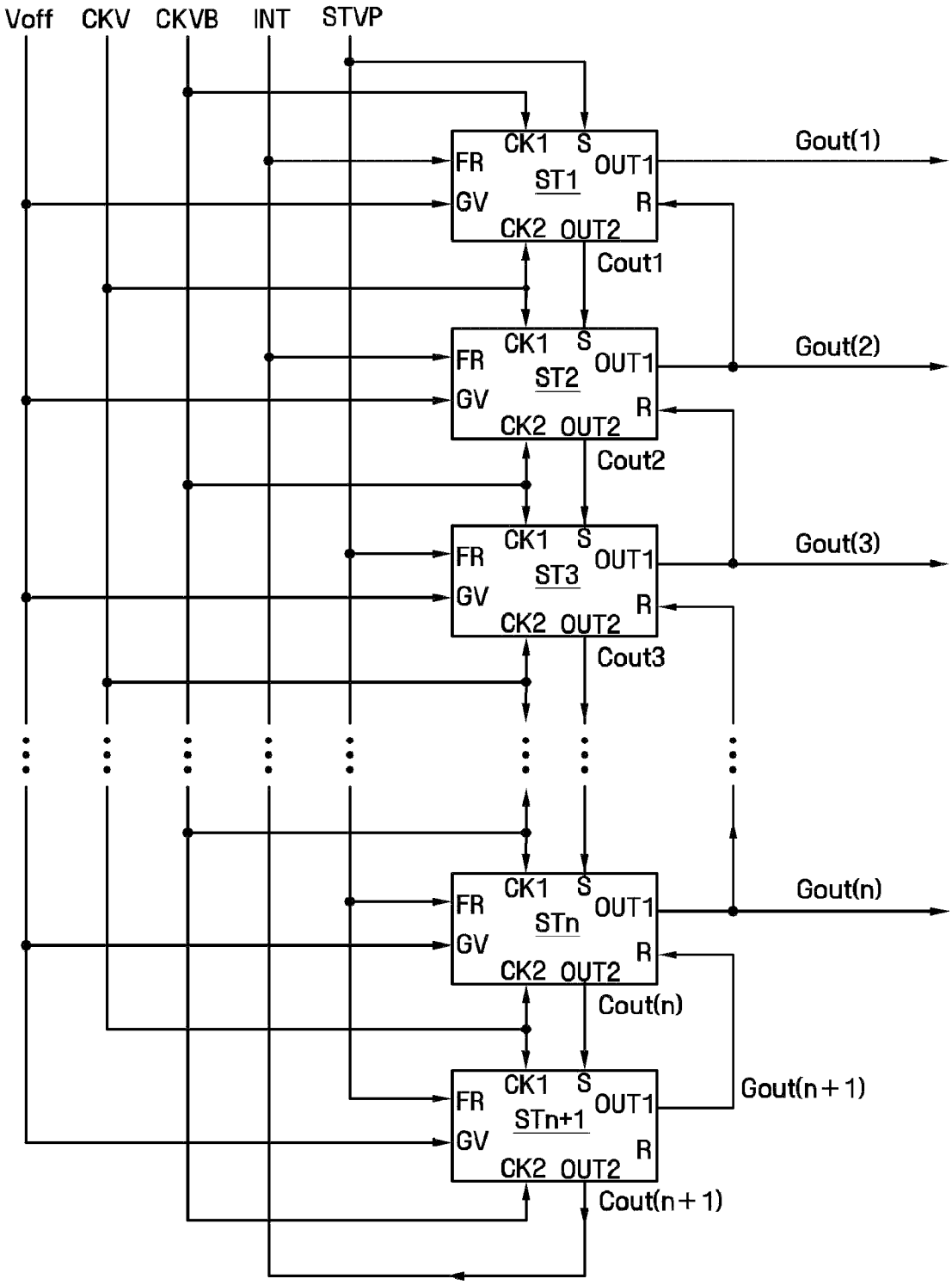
FIG. 9 is a block diagram of a gate driver included in an LCD according to another exemplary embodiment of the present invention.
Figure 10:
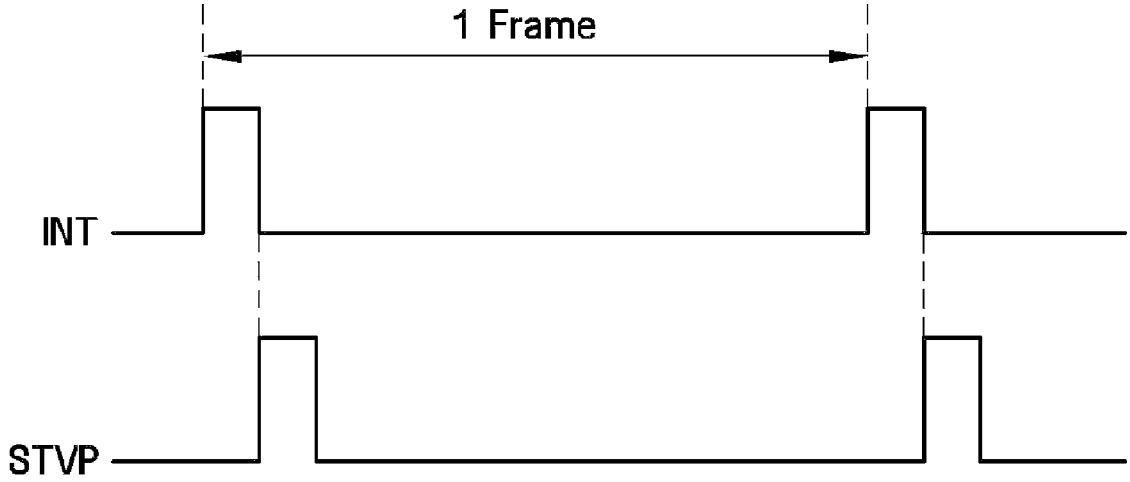
FIG. 10 is a signal diagram of initialization signals and scan start signals inputted in the gate driver of FIG. 9.

Hereinafter, an LCD according to another exemplary embodiment of the present invention will be explained with reference to FIGS. 9 and 10. FIG. 9 is a block diagram of a gate driver included in an LCD according to another exemplary embodiment of the present invention. FIG. 10 is a signal diagram of initialization signals and scan start signals inputted in the gate driver of FIG. 9.

The LCD according to another exemplary embodiment of the present invention is different from the above embodiments in that only a few stages among several stages are initialized in response to the initialization signal, and the remaining stages and dummy stages are initialized in response to the scan initialization signal, which are differences.

Referring to FIG. 9, the LCD according to another exemplary embodiment of the present invention includes an LCD panel that includes a multiple of gate lines (G1 to Gn), and a gate driver that includes the first through $n^{th}$ stages $ST_1$ through $ST_n$ and a dummy stage STn+1 that are connected to a multiple of gate lines G1 to Gn and gradually provide gate signals $Gout_{(1)}$ to $Gout_{(n)}$. Here, at least one stage of the first through $n^{th}$ stages $ST_1$ through $ST_n$ and the dummy stage STn+1 is initialized each frame in response to the scan start signal STVP. And, the remaining stages among the first through $n^{th}$ stages $ST_1$ through $ST_n$ provide the initialization signal INT from the dummy stage STn+1.

As shown in FIG. 9, the first through nth stages $ST_1$ through $ST_n$ may include linearly connected first to nth stages. As described above, each of the multiple of stages and a dummy stage STn+1 may include a first clock terminal CK1, a second clock terminal CK2, a set terminal S, a reset terminal R, a power voltage terminal Gv, a frame reset terminal GV, a gate output terminal OUT1 and a carry output terminal OUT2.

The LCD according to another exemplary embodiment of the present invention is different from the above embodiments in that the initialization signal INT or scan start signal STVP is inputted to the frame rest terminal FR. In other words, a portion of the first through $n^{th}$ stages $ST_1$ through $ST_n$ and the dummy stage STn+1 receives the scan start signal STVP provided by the frame reset terminal FR, and the remaining stages receive the initialization signal INT provided by the frame reset terminal FR.

Here, a portion of the first through $n^{th}$ stages $ST_1$ through $ST_n$ and the dummy stage STn+1 may be arbitrarily determined. For example, as illustrated in FIG. 9, the initialization signal INT may be provided only to the frame reset terminal FR of a series of first through kth stages ST1 to STk (k is a natural number smaller than n), and the scan start signal STVP may be provided to the frame reset terminal FR of the remaining K+1th to nth stages STk+1 to STn.

Here, k may be "2." That is, as illustrated in FIG. 9, the initialization signal may be provided only to the first and second stages ST1 and ST2, and the scan start signal STVP may be provided to the third and nth stages ST3 to STn and the dummy stage.

Further, as illustrated in FIG. 9, the connection between each stage and the scan start signal STVP wiring may become easier by positioning the wiring of the scan initialization signal STVP closer to the first through $n^{th}$ stages $ST_1$ through $ST_n$ and the dummy stage STn+1 than the wiring of the initialization signal INT. In other words, a path of the scan start signal is formed nearer to the gate driver than a path of the initialization signal.

Referring to FIG. 10, both the initialization signal INT and the scan start signal STVP are provided with one frame period, and the scan start signal STVP may be authorized to the k+1th to nth stages STk+1 to STn and the dummy stage STn+1 after the initialization signal INT is authorized to a few stages, e.g., the 1st through the kth stages ST1 to STk.

Specifically, while the initialization signal INT provided to the frame reset terminal FR of the first through the kth stages ST1 to STk is kept at the first level, e.g., about −7V, if it is turned to the second level, e.g., about 27V, the the first to the kth stages ST1 to STk may be initialized.

Then, after the initialization signal INT is turned from the second level to the first level, while the scan start signal STVP is kept at the first level, e.g., about −7V, it may be turned into the second level, e.g., about 27V. In response to the scan start signal STVP, k+1th to nth stages STk+1 to STn may initialize each stage.

As illustrated above, the initialization signal INT and the scan start signal STVP are authorized in frame units, so the transistor T6 connected with the frame reset terminal FR of the first through $n^{th}$ stages $ST_1$ through $ST_n$ and the dummy stage STn+1 may be operated once per frame.

According to an LCD device according to another exemplary embodiment of the present invention, a portion among the first through $n^{th}$ stages $ST_1$ through $ST_n$ and the dummy stage STn+1 is initialized using the initialization signal INT, and the remaining stages are initialized using the scan start signal STVP, thereby allowing the dummy stage STn+1 to provide the initialization signal INT more stably. Specifically, the burden of the capacity of the pull up transistor T1 output of the dummy stage STn+1 is significantly reduced, and the margin for the wiring operation of the initialization signal INT, which has relied on the output of the pull up transistor T1, is sufficiently secured, which are advantageous.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display (LCD), comprising:

a liquid crystal panel comprising a plurality of gate lines; and a gate driver comprising a plurality of stages, which are connected to the gate lines, respectively, and are configured to sequentially provide a plurality of gate signals to the gate lines, respectively, and a first dummy stage and a second dummy stage, wherein the second dummy stage is configured to reset the first dummy stage independently from the plurality of stages.

2. The LCD of claim 1, wherein the first dummy stage is configured to be enabled by a carry signal of any one of the stages, the second dummy stage is configured to be enabled by a carry signal of the first dummy stage and initialize the plurality of the stages, and the liquid crystal panel further comprises a plurality of dummy gate lines, and the first dummy stage is connected to at least one of the dummy gate lines.

3. The LCD of claim 2, wherein the first dummy stage is enabled by a carry signal of a last one of the stages.

4. The LCD of claim 3, wherein the gate signal of each of the stages is pulled down to a gate-off voltage in response to a gate signal of a next stage or an initialization signal of the second dummy stage, and a gate signal of the first dummy stage is pulled down to the gate-off voltage in response to the initialization signal of the second dummy stage.

5. The LCD of claim 4, wherein the initialization signal of the second dummy stage is a carry signal, which is provided to each of the stages and initializes each of the stages.

6. The LCD of claim 1, wherein the second dummy stage provides the initialization signal to each of the stages at every frame and initializes each of the stages.

7. A liquid crystal display (LCD), comprising:

a liquid crystal panel comprising a plurality of qate lines; and a gate driver comprising a plurality of stages, which are connected to the gate lines, respectively, and sequentially provide a plurality of qate signals to the qate lines, respectively, and a first dummy stage and a second dummy stage, wherein the first dummy stage is enabled by a carry signal of any one of the stages, and the second dummy stage is enabled by a carry signal of the first dummy stage and initializes each of the stages, and the liquid crystal panel further comprises a plurality of dummy gate lines, and the first dummy stage is connected to at least one of the dummy qate lines, wherein each of the stages, the first dummy stage, and the second dummy stage comprises:

a charging unit charged with electric charges in response to a scan start signal or a carry signal of a previous stage;

a pull-up unit that provides a gate signal in response to a first clock signal or a second clock signal when the charging unit is charged;

a pull-down unit that pulls down the gate signal to the gate-off voltage in response to the gate signal of the next stage or an initialization signal of the second dummy stage;

a discharging unit that discharges the electric charges from the charging unit; and a holding unit that holds the gate signal, and wherein the discharging unit comprises a first transistor, which discharges the charging unit in response to the gate signal of the next stage, and a second transistor which discharges the charging unit again in response to the initialization signal of the second dummy stage.

8. The LCD of claim 7, wherein the stages comprise first through n-th stages, wherein the first through n-th stages and the first dummy stage and second dummy stage are arranged sequentially, and the scan start signal is provided to the first stage and the second dummy stage.

9. A liquid crystal display (LCD), comprising:

a liquid crystal panel comprising a plurality of gate lines; and a gate driver comprising a plurality of stages, which are connected to the gate lines, respectively, and sequentially provide a plurality of gate signals to the gate lines, respectively, and a dummy stage, wherein each of the stages and the dummy stage comprises:

a charging unit that is charged with electric charges in response to a scan start signal or a carry signal of a previous stage;

a pull-up unit that provides a gate signal in response to a first clock signal or a second clock signal when the charging unit is charged;

a pull-down unit that pulls down the gate signal to a gate-off voltage in response to a gate signal of a next stage or an initialization signal;

a discharging unit that discharges the electric charges from the charging unit;

and a holding unit that holds the gate signal, wherein the dummy stage comprises a pull-up transistor larger than that of each of the stages.

10. The LCD of claim 9, wherein the pull-up transistor of the dummy stage is more than 20% larger than that of each of the stages.

11. The LCD of claim 9, wherein the liquid crystal panel further comprises a plurality of dummy gate lines, and the dummy stage is connected to at least one of the dummy gate lines.

12. The LCD of claim 11, wherein the dummy stage is enabled by a carry signal of a last one of the stages and provides the initialization signal.

13. The LCD of claim 9, wherein the dummy stage provides the initialization signal to each of the stages at every frame and initializes each of the stages.

14. A liquid crystal display (LCD), comprising:

a liquid crystal panel comprising a plurality of gate lines; and a gate driver comprising a plurality of stages, which are connected to the gate lines, respectively, and sequentially provide a plurality of gate signals to the gate lines, respectively, and a dummy stage, wherein each of the stages and the dummy stage comprises a gate output terminal which provides a gate signal, and the gate signal output from the gate output terminal of the dummy stage has a smaller output than the gate signal output from the gate output terminal of each of the stages.

15. The LCD of claim 14, wherein the output voltage of the gate signal of the dummy stage is less than 80% of the output voltage of the gate signal of each of the stages.

16. The LCD of claim 14, wherein the gate signal output from the dummy stage has a lower voltage level than that of the gate signal output from each of the stages.

17. The LCD of claim 14, wherein the dummy stage is enabled by a carry signal of a last one of the stages and provides the initialization signal to each of the stages for each frame.

18. A liquid crystal display (LCD) comprising:

a liquid crystal panel comprising a plurality of gate lines; and a gate driver comprising a plurality of stages, which are connected to the gate lines, respectively, and sequentially provide a plurality of gate signals to the gate lines, respectively, and a dummy stage, wherein at least one of the plurality of stages and the dummy stage is initialized for each frame in response to a scan start signal.

19. The LCD of claim 18, wherein the dummy stage is configured to provide at least one of the plurality of stages with an initialization signal which initializes the stage.

20. The LCD of claim 19, wherein a path of the scan start signal is formed closer to the gate driver than a path of the initialization signal.

* * * * *